United States Patent [19]

Hovanic

[11] Patent Number: 4,835,501

[45] Date of Patent: May 30, 1989

[54] CURRENT LIMITING ASSEMBLY FOR CIRCUIT BREAKERS

[75] Inventor: Steven F. Hovanic, Barboursville, Va.

[73] Assignee: Cooper Industries, Inc., Houston, Tex.

[21] Appl. No.: 95,208

[22] Filed: Sep. 11, 1987

[51] Int. Cl.[4] ..... H01H 75/00

[52] U.S. Cl. ..... 335/16; 335/195; 335/147

[58] Field of Search ..... 335/16, 147, 195; 200/144 R

[56] References Cited

U.S. PATENT DOCUMENTS 4,219,790 8/1980 Batteux et al. ..... 335/16

4,550,299 10/1985 Bachler ..... 335/147

*Primary Examiner*—Joseph W. Hartary

*Assistant Examiner*—Lincoln Donovan

*Attorney, Agent, or Firm*—Nelson A. Blish; Eddie E. Scott; Alan R. Thiele

[57] ABSTRACT

A current limiting assembly through which current may flow includes a stationary contact member, a movable contact member positioned in relation to the stationary contact member so that current flow through and from the stationary contact member into and through the movable contact member generates electromagnetic forces which create a repulsive force tending to force the movable contact member away from the stationary contact member, and a magnetic flux intensifying structure mechanically staked to said stationary contact member.

10 Claims, 1 Drawing Sheet

CURRENT LIMITING ASSEMBLY FOR CIRCUIT BREAKERS

BACKGROUND OF THE INVENTION

1. Field of the Invention

This invention relates to circuit breakers and, more particularly, to circuit breakers wherein electromagnetic repulsion forces assist in current limitation.

2. Description of Related Art

The interrupting rating of a circuit breaker can be economically increased by using a current limiting set of contacts which may be added onto an existing circuit breaker or integrally formed in a breaker. The current limiting contacts limit the amount of current that would flow through the breaker under short circuit conditions which enables the breaker to be designed to interrupt that maximum amount rather than an unlimited amount from a source capable of generating extremely high short circuit currents. Typically, current limiting circuit breakers operate on an electromagnetic repulsion principle wherein as the magnitude of the fault current increases to a pre-selected magnitude, the magnetic forces build which tend to repel a movable contact away from a stationary contact thereby interrupting the circuit. In the design of current limiting contacts, it is important that when the contacts are closed, there is sufficient contact pressure to assure minimal resistance to current flow but that the means for insuring the requisite contact pressure does not inhibit the fast operation under fault conditions.

The actual current limiting apparatus of prior art circuit breakers generally comprise spaced conductors and associated structure which is capable of causing a repulsive force to arise between the conductors. Examples of prior art circuit breakers having these elements are disclosed in U.S. Pat. No. 4,001,738 to Terracol et al. and U.S. Pat. No. 3,887,888 to Bayles et al. Terracol et al. describe a circuit breaker utilizing an electromagnetic repulsive force to effectuate an abrupt separation of a movable contact from a stationary contact. In Terracol et al.'s breaker, current flows in one direction through the stationary contact arm and in second direction through the movable contact arm. A conducting induction plate containing a return conductor forms a cage imprisoning the movable contact arm. The secondary currents in this induction plate tend to force the movable contact arm vigorously away from the stationary contact arm. The patent to Bayles et al. depicts a high current switch provided with a U-shaped stationary yoke piece provided around stationary and movable contacts.

While prior art circuit breakers, such as those identified above, generally operate acceptably in response to high level fault conditions, those skilled in the circuit breaker manufacturing art recognize or should appreciate the undue complexity and high cost of manufacturing the prior art circuit breakers. With regard to the Bayles et al. breaker, for example, it is necessary to provide proper positioning of components and to provide an insulating barrier between the yoke and movable conductor during manufacture. The technique most often employed to accomplish this relies upon a complex molded plastic housing into which the yoke is inserted, which in turn must be secured and suitably positioned around the conducting members. Various supplementary insulating materials (fiber sheet, silicone adhesive, and so on) are still often required to maintain adequate dielectric strength between the current limiting apparatus and other breaker components. Overall complexity is further increased by, in many cases, having separate fasteners to secure both the stationary conducting member, as well as the current limiting apparatus, to the breaker housing.

Accordingly, it should be appreciated that there is a need for a simple current limiting assembly for circuit breakers that can be easily and inexpensively manufactured.

SUMMARY OF THE INVENTION

According to the present invention, in its broadest terms, a current limiting circuit breaker has a stationary contact member, a movable contact member positioned in relation to the stationary contact member so the current flow through and from the stationary contact member into and through the movable contact member generates electromagnetic forces which create a repulsive force tending to force the movable contact member away from the stationary contact member, and a magnetic flux intensifying structure mechanically staked to said stationary contact member.

In the preferred embodiment of the present invention, the invention is directed to a blow out mechanism in a current limiting circuit breaker wherein electromagnetic repulsion forces are utilized to quickly separate the stationary contact in the circuit breaker from the movable contact. The stationary contact member is provided upon a U-shaped base having current flowing therein. The movable contact is connected to a linear contact arm which is parallel to the U-shaped member. Since current flowing in opposite directions between the top portion of the U-shaped member and the linear contact arm, a repulsive force is provided between those members which facilitates the separation between the two contacts. A steel U-shaped yoke is provided between the legs of the secondary U-shaped member and extends around the linear arm. This U-shaped yoke is mechanically staked to the U-shaped member and then molded with a thermoset insulating material.

It is a primary object of the present invention, therefore, to provide a current limiting assembly for circuit breakers that is less complex than prior art assemblies.

It is another object of the present invention to provide a simple current limiting circuit breaker.

It is yet another object of the present invention to provide a current limiting assembly for circuit breakers that is easy and inexpensive to manufacture.

Other objects, advantages and novel features of the present invention will become apparent from the following detailed description of the invention when considered in conjunction with the accompanying drawings wherein:

DETAILED DESCRIPTION OF THE INVENTION

Figure 1:
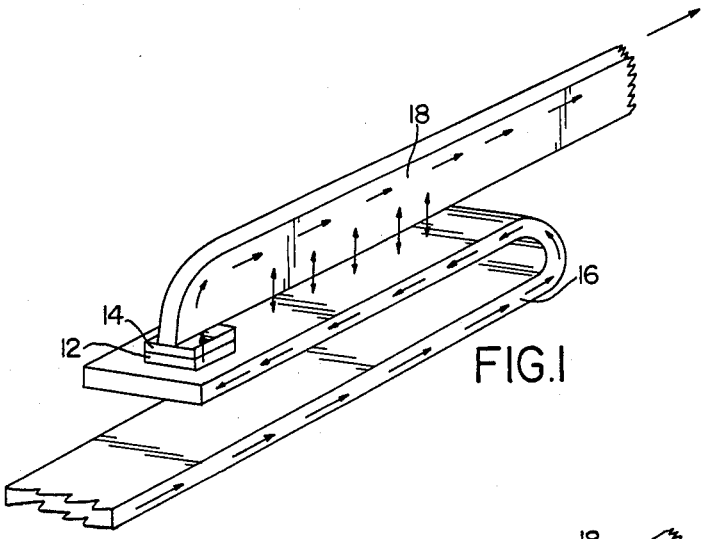
FIG. 1 is a representation of certain elements of the present invention wherein key forces are shown symbolically.
Figure 2:
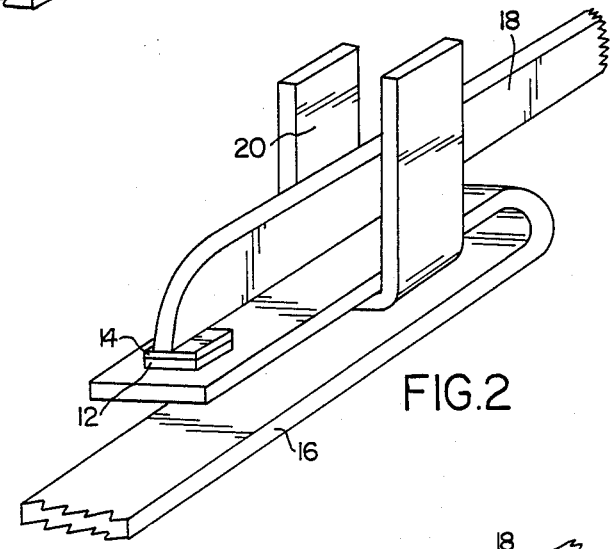
FIG. 2 is a representation of the elements shown in FIG. 1 and an additional element, all of the foregoing shown in a state of partial manufacture.

Referring now to the drawings wherein like reference characters designate identical or corresponding parts throughout the several views and, more particularly, to FIG. 1, a representation of a portion of a current limiting assembly according to the present invention is shown therein to include separable contacts in the form of a stationary contact 12 and a movable contact 14. The stationary contact 12 is mounted on a U-shaped base or stationary contact member 16 and the movable contact 14 is mounted on a linear arm or movable contact member 18 which is disposed in close proximity and parallel relationship to a one, upper, leg of the U-shaped member 16. Noting that direction of current flow through the assembly is indicated by single headed arrows, it should be appreciated that the effective current path through the assembly, that is, through and from the upper leg of stationary member 16 through the contacts 12, 14 into and through the movable member 18, is essentially a narrow spaced "U" with current flowing in opposite directions through the legs of the "U". Those skilled in the relevent art should also appreciate that electromagnetic forces arise because of such current flow, which electromagnetic forces create a repulsive force, indicated by the two headed arrows in FIG. 1, tending to force members 16, 18 apart. Conventionally, contacts such as contacts 12, 14 are held in contact by a spring (not shown) or other such biasing force acting on contact holding members such as members 16, 18. The repulsive force mentioned above is proportional to the value of the current squared. At certain short circuit current levels the repulsive force can be considerably greater than the mechanical spring force holding the contacts 12, 14 closed. As this same repulsive force acts also in the "U" section of stationary contact member 16 itself, it is important that member 16 possess sufficient mechanical strength to resist deformation due to existence and operation of the repulsive force.

A U-shaped member or yoke 20 of steel or similar magnetic flux intensifying material is disposed between the legs of the stationary U-shaped member 16 and extends around the linear arm 20. In accordance with a key aspect of the present invention, yoke 20 is mechanically staked to member 16, thereby creating a one piece assembly of elements 12, 16 and 20. Advantages of this aspect of the present invention are discussed in detail below.

Figure 3:
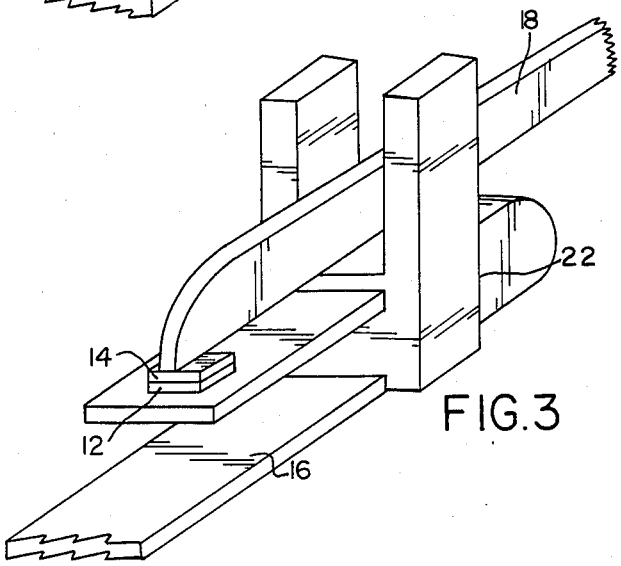
FIG. 3 is a representation of a completed assembly according to the present invention.

With reference now to FIG. 3, it may be seen that an insulating coating 22 is provided between the movable contact member 18 and the upper leg; that is, the leg of the U closest to member 18, of member 16; between yoke 22 and movable contact member 18; and between the upper and lower legs of member 16.

Those skilled in the art should appreciate how the above-described elements can operate together to rely upon electromagnetic forces to separate the contacts 12, 14 and cause an arc to be blown into arc quenching grids, thus, creating a high arc resistance and a reduced current flow through a breaker. Magnetic flux is intensified by the presence of the steel yoke 22, causing the repulsive force to be increased and creating a force tending to blow the arc column into the arc quenching grids. This secondary feature causes the arc to be broken up into a series of short arcs with a larger arc resistance and a corresponding lower current flow as discussed above. Insulation is necessary because of the electric potentials involved. The insulating coating, typically of thermoset plastic material, provides resistance to erosion during arcing as well as dielectric strength.

Because a one piece assembly 12, 16, 20 is created by mechanical staking under the terms of the present invention, the insulating coating 22 can be easily provided in a number of ways. One way would be as an insert molded product, with the original assembly serving as the insert, and with suitable mold design to maintain encapsulation with insulating material as required. Another way would be as a powder coated product, whereby after suitable masking of assembly, thermoset powder is caused to adhere to assembly and the cured at elevated temperature to provide dielectric encapsulation. Whichever of the above or similar or other known ways is chosen, because yoke 20 is mechanically staked to member 12, the present invention avoids the problems of relying upon a complex molded plastic housing into which a yoke is inserted, which in turn must be secured and suitably positioned around conducting members. Application of supplementary insulating materials, as those skilled in the art should readily appreciate, is also simplified by application of the present invention. An assembly constructed according to the present invention can be expected to have mechanical integrity, can also be expected to provide adequate dielectric strength between itself and other breaker components, and can be assembled readily into a breaker housing without necessity for additional insulators. Fastening the assembly in place is likewise simplified due to the one piece construction.

Obviously, many modifications and variations of the present invention are possible in light of the above teachings. It is therefore to be understood that within the scope of the appended claims, the invention may be practiced otherwise than as specifically described.

I claim:

1. A current limiting assembly through which current may flow comprising:

a stationary contact member;

a movable contact member positioned in relation to the stationary contact member so that current flow through and from the stationary contact member into and through the movable contact member generates electromagnetic forces which create a repulsive force tending to force the movable contact member away from the stationary contact member, and a magnetic flux intensifying structure mechanically staked to said stationary contact member.

2. The assembly of claim 1 wherein the magnetic flux intensifying structure includes portions which extend around portions of the movable contact member.

3. The assembly of claim 2 wherein the magnetic flux intensifying structure includes portions which extend around portions of the stationary contact member.

4. The assembly of claim 3 wherein the magnetic flux intensifying structure is a U-shaped steel yoke.

5. The assembly of claim 4 further comprising an insulating coating between the movable contact member and the stationary contact member and between the yoke and the movable contact member.

6. The assembly of claim 5 wherein said insulating coating comprises thermoset material.

7. A current limiting assembly through which current may flow and in which a predetermined repulsive force is generated, comprising:

a stationary contact;

a movable contact;

a U-shaped base upon which said stationary contact is mounted;

said U-shaped base having two leg portions;

a linear arm upon which said movable contact is mounted so as to be in contact with said stationary contact in the absence of a predetermined repulsive force, said linear arm positioned in relation to said U-shaped base so that current flowing through the assembly flows in opposite directions between one of the leg portions of said U-shaped base and said linear arm, said linear arm further positioned in relation to said U-shaped base so that the opposite current flow causes a repulsive force to arise which facilitates separation of the stationary and movable contact; and a magnetic flux intensifying structure mechanically staked to said U-shaped base so as to have portions extending around portions of said U-shaped base.

8. The assembly of claim 7 wherein said magnetic flux intensifying structure further includes portions extending around portions of said linear arm.

9. The assembly of claim 8 wherein said magnetic flux intensifying structure comprises a U-shaped steel yoke.

10. The assembly of claim 9 further comprising insulating coating disposed between said linear arm and the one of the leg portions of said U-shaped base, between said yoke and said linear arm, and between the one of the leg portions of the U-shaped base and the other of the leg portions of said U-shaped base.

* * * * *